United States Patent [19]

Horan

[11] Patent Number: 4,648,604

[45] Date of Patent: Mar. 10, 1987

[54] ELIMINATION DRAW POKER GAME

[75] Inventor: Michael J. Horan, Pompano, Fla.

[73] Assignee: Professional Video Association, Inc., Pompano Beach, Fla.

[21] Appl. No.: 728,288

[22] Filed: Apr. 29, 1985

[51] Int. Cl.[4] ..... A63F 1/00

[52] U.S. Cl. ..... 273/292; 273/85 CP

[58] Field of Search ..... 273/292, 303, 85 CP

[56] References Cited

U.S. PATENT DOCUMENTS 3,876,208 4/1975 Wachtler et al. ..... 273/85 CP 4,339,134 7/1982 Macheel ..... 273/85 CP

*Primary Examiner*—Anton O. Oechsle

*Attorney, Agent, or Firm*—Robert D. Yeager; George D. Dickos

[57] ABSTRACT

A method for playing draw poker in which cards used in previous hands are retired from play and a time limit is imposed for completing a predetermined number of hands.

1 Claim, No Drawings

ELIMINATION DRAW POKER GAME

BACKGROUND OF THE INVENTION

1. Field of the Invention

This invention relates to a method of playing a card game; more particularly to playing within a specified time period a plurality of hands of conventional draw poker and retiring from further play all cards expended in preceding hands.

2. Description of the Prior Art

The game of draw poker played with a deck of 52 conventional playing cards is well-known. The object of the present invention is to modify the established rules of conventional draw poker to progressively reduce the element of chance in playing consecutive hands of draw poker while demanding increased mental skill of the player as play proceeds and, further, to impose upon the player a requirement to complete a predetermined number of consecutive hands of draw poker within a predetermined time period.

In the well-known card game of bridge, cards utilized in the playing of each trick are eliminated from further play, thereby requiring the players to attempt to memorize the cards expended on each trick in order to predict the remaining cards held by other players. By contrast, after each hand of conventional poker, all cards are collected and shuffled for the next hand. The memory of the player is, therefore, not taxed in terms of predicting the cards to be dealt in the next hand. The introduction into the game of draw poker of the requirement for memorizing cards played has the tendency to raise the level of skill needed by a player for successful play. To impose a time limit within which the player must play a predetermined number of hands of draw poker in order to receive maximum credit for those hands still further increases the level of skill needed for successful play.

SUMMARY OF THE INVENTION

The present invention provides a method of playing a card game comprising the steps of: displaying to a player five randomly selected playing cards of the type found in a conventional 52 card deck of playing cards; (b) permitting the player to draw one or more additional randomly selected playing cards in substitution for the originally displayed cards; (c) assigning a value to the hand of five cards remaining with the player after step (b) by recognizing the presence or absence in the hand of playing card combinations established in the game of draw poker; (d) retiring from further play all cards utilized in the immediately preceding performance of steps (a) and (b); (e) repeating steps (a) through (d) in sequence for a predetermined number of repetitions; and (f) totalling the values achieved by the player in all the repetitions completed by the player within a predetermined time period.

The card game of the present invention may, of course, be played manually with a deck of 52 conventional playing cards comprising four suits (spades, hearts, diamonds, clubs) of thirteen cards. More importantly, however, the game can be played by use of electronic video apparatus in which the cards are displayed on a video tube and are "dealt" by means of a conventional random number generator. The use of such equipment readily lends itself to tying a number of such devices to a central monitoring station by means of telecommunications equipment, thereby permitting players located over a wide geographic area to engage in competition.

DETAILED DESCRIPTION OF THE PREFERRED EMBODIMENTS

The present invention will be described by reference to the use of a deck of 52 conventional playing cards handled by a dealer and manually dispensed or dealt to a player. To begin play, a timing device is activated. After the cards are shuffled, the player is dealt five cards and is permitted to draw one or more, preferably up to five, additional cards in substitution for the original cards in order to improve his hand. Prior to drawing additional cards, the player may raise in accordance with conventional poker practice.

After either standing pat or exercising the right to draw, as the case may be, the player's hand is evaluated in accordance with standard poker practice (e.g. straight, full house, etc.). The score for the hand is tallied and the cards dispensed in that hand are retired from play. The player is dealt a new hand and play proceeds as just described. Because cards have been retired from play, the player's draw decisions are increasingly influenced by those cards. The player is required to complete a predetermined number of hands, up to a maximum of five, within a predetermined time period, say three minutes. If the time period expires before the player completes a particular hand, the score for that hand is excluded from the player's total score.

What is claimed is:

1. A method of playing a card game comprising the steps of:

(a) displaying to a player five randomly selected playing cards of the type found in a conventional 52 card deck of playing cards;

(b) permitting said player to draw one or more additional randomly selected playing cards in substitution for the originally displayed cards;

(c) assigning a value to the hand of five cards remaining with said player after step (b) by recognizing the presence or absence in said hand of playing card combinations established in the game of draw poker;

(d) retiring from further play all cards utilized in the immediately preceding performance of steps (a) and (b);

(e) repeating steps (a) through (d) in sequence for a predetermined number of repetitions; and (f) totalling the values achieved by said player in all said repetitions completed by said player within a predetermined time period.

* * * * *